United States Patent [19]

Smith

[11] Patent Number: 4,856,434

[45] Date of Patent: Aug. 15, 1989

[54] SMITTY TABLE

[76] Inventor: Gene A. Smith, 5725 N.W. Blvd., Davenport, Iowa 52806

[21] Appl. No.: 289,685

[22] Filed: Dec. 27, 1988

[51] Int. Cl.[4] ..... B65D 19/12

[52] U.S. Cl. ..... 108/53.1; 108/111; 108/56.3

[58] Field of Search ..... 108/53.1, 56.1, 56.3; 211/186, 188, 194

[56] References Cited

U.S. PATENT DOCUMENTS

| | | | |
|---|---|---|---|
| 2,005,566 | 6/1935 | Schwabe | 108/111 |
| 3,506,138 | 4/1970 | Travis | 108/56.1 X |
| 3,771,466 | 11/1973 | Ferdinand et al. | 108/111 X |
| 4,027,599 | 6/1977 | Sapp et al. | 108/56.1 X |
| 4,231,300 | 11/1980 | Shepard | 108/111 |
| 4,703,702 | 11/1987 | Speicher | 108/56.3 |

*Primary Examiner*—Peter A. Aschenbrenner
*Attorney, Agent, or Firm*—Robert O. Richardson

[57] ABSTRACT

A shipping, storing and displaying table that is collapsible for return and which is inexpensive for discard if desired. The table consists of a plurality of vertically spaced shelves supported by their edges held between lips of supports or posts at their midsections. The posts have feet extending below the lower shelf or pallet base to provide forklift access from all four sides. The posts and shelves are held together by connecting bands of suitable fasteners such as nails or screws, all of which are readily removable for collapsing the table.

5 Claims, 3 Drawing Sheets

SMITTY TABLE

BACKGROUND OF THE INVENTION

Racks are used in shipping, storing and displaying small crushable or sensitive items such as pots and trays of flowers, vegetable plants and similar items. Presently, plants are shipped on returnable racks or disposable cartons. Usually the returnable racks are made of welded steel tubing or angular steel supporting layers of wood shelving. After the items have been shipped or after they have been displayed and sold, the racks have to be returned to the provider of the the items. The return of empty racks can be expensive and burdensome. Hence, partial and fully disposable racks have been developed but their single use is also an expense. A sturdy but collapsible rack can be reused, yet is so compact that return shipping is a minimal expense and the cost is such that multiple use by returning the rack is an attractive option.

SUMMARY OF THE PRESENT INVENTION

In accordance with the present invention a collapsable, shipping, storing and displaying table has been developed that is so cost effective that it may be returned in collapsed condition or discarded as a throw-away item. By centering the vertical supports or posts of the table along each pallet edge, a four way forklift entry is provided which has advantages over conventional pallets that are restricted to two way entry. Moreover, the centered supports or posts provide greater stability than corner posts when positioned on uneven ground. This becomes important when the tables are stacked and the center of gravity becomes higher.

A few years ago the permissive width of a semi-trailer was changed from 96 inches to 102 inches outside width. Shipping pallets and racks, for maximum shipping capacity, had to be sized for use in the old and in the new width trailers. Accounting for 1 1/2 to 2 inch thick sidewalls, 3-32½ inch wide racks will fit across a 102 inch wide trailer. Also 2-45 inch long rack pallets will fit across a 96 inch wide trailer. To permit a little room for clearance, the pallets used in the rack or table of the present invention are 32 inches wide and 43⅞ inches long. The shelving, except for the base pallet, preferably is ½ inch particle or ply board while the base pallet board is ¾ inch thick. However, these deminsions and thicknesses may be varied as desired.

The vertical supports of the table, hereinafter referred to as Smitty Posts, are centered along the length and width of the vertically spaced shelves. Spaced horizontally extending lips on the Smitty Posts engage the shelf edges for shelf support. Screw holes and slots are in the posts along the lips so that the posts and shelves may be held together with nails or screws, or straps may be passed through the slots in the Smitty Posts and around the posts and shelves to bind them all together.

Smitty Tables built in accordance with the present invention have a number of advantages. They cost less than conventional steel racks. They increase the loading capacity by about 20%. They create their own display tables for mass merchandising. They can be loaded on any size truck and will fit through any truck door opening including pick-ups and vans. They can be disassembled easier and are more compact than any other known shipping rack. They can be stored in 10% of the space needed to store steel racks of similar capacity. They have a lower maintenance cost since they will not rust and need no painting or welding. Since the shelves can be made any size and have a variable verticle spacing, any size containers may be used in the shipping, storing or displaying of items. They are very mobile and may be moved conveniently through most store door openings for daytime outdoor display and nighttime indoor storage. The lower pallet base permits four way forklift entry for rapid and convenient relocation as desired. Other advantages will occur as a more detailed description of the preferred embodiment is made with reference to the drawings set forth herein.

DETAILED DESCRIPTION OF PREFERRED EMBODIMENT

Figure 1:
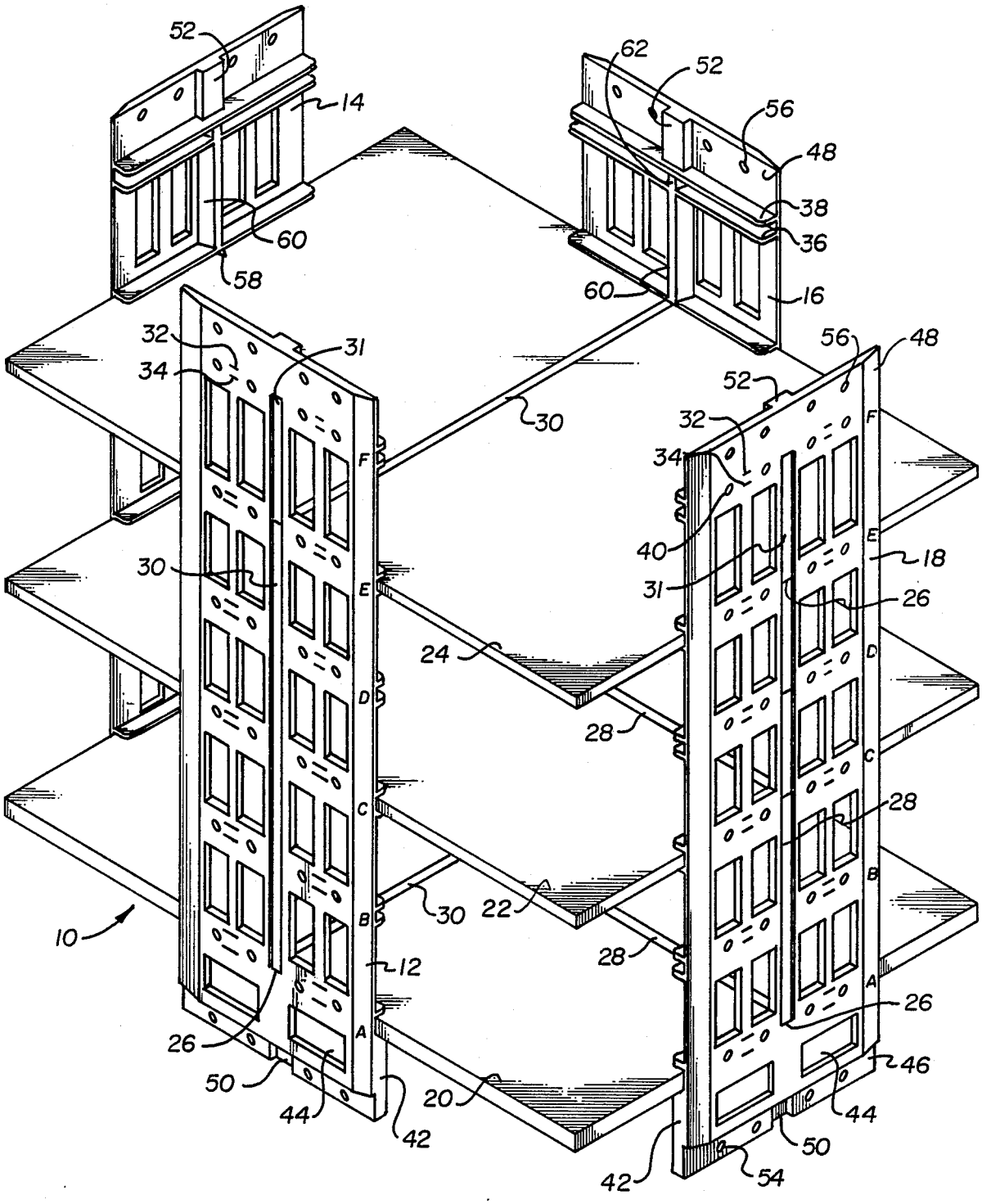
FIG. 1 is a perspective view of the Smitty Table with shelving in the first, third and fifth positions on the centrally positioned posts.

Reference is now made to FIG. 1 which shows in perspective a Smitty Table 10. This table consists of four vertical Smitty Posts 12, 14, 16, 18 each centered along an edge of pallet base board 20 and shelves 22, 24 at levels A, C and E. As will be seen hereinafter these posts are adapted to secure shelves at levels B, D and F also. The posts have central slots 26 at the various levels through which steel or plastic bands 28, 30 pass and are fastened to make the table into a single integral unit. When these bands are cut the table collapses to less than 10% of its size. The Smitty Posts are recessed at 31 on their outer surfaces between these slots so that the bands will be flush with the outer surface and will not snag in loading or unloading onto semi-trailer trucks having close clearance with the tables stored therein. It should be noted that band 28 passes over the top surface of pallet base board 20 at level A and over shelf 22 at level C in connecting supports 14, 18 while band 30 passes over pallet base board 20 at level A and over shelf 24 at level E. Band 30 connects supports 12, 16, all with pallet 20 and shelves 22, 24 sandwiched in between. As other shelves are added at levels B, D and F, additional bands may be added. These bands may be looped through other central slots 26 or passed through auxillary upper or lower slots 32, 34 in the vertical posts which are to the right and left of the central slots 26. As will appear hereinafter, these auxillary slots in the posts are above and below the shelves to guide the bands above or below the shelves as directed by the operator constructing a desired table configuration.

Figure 5:
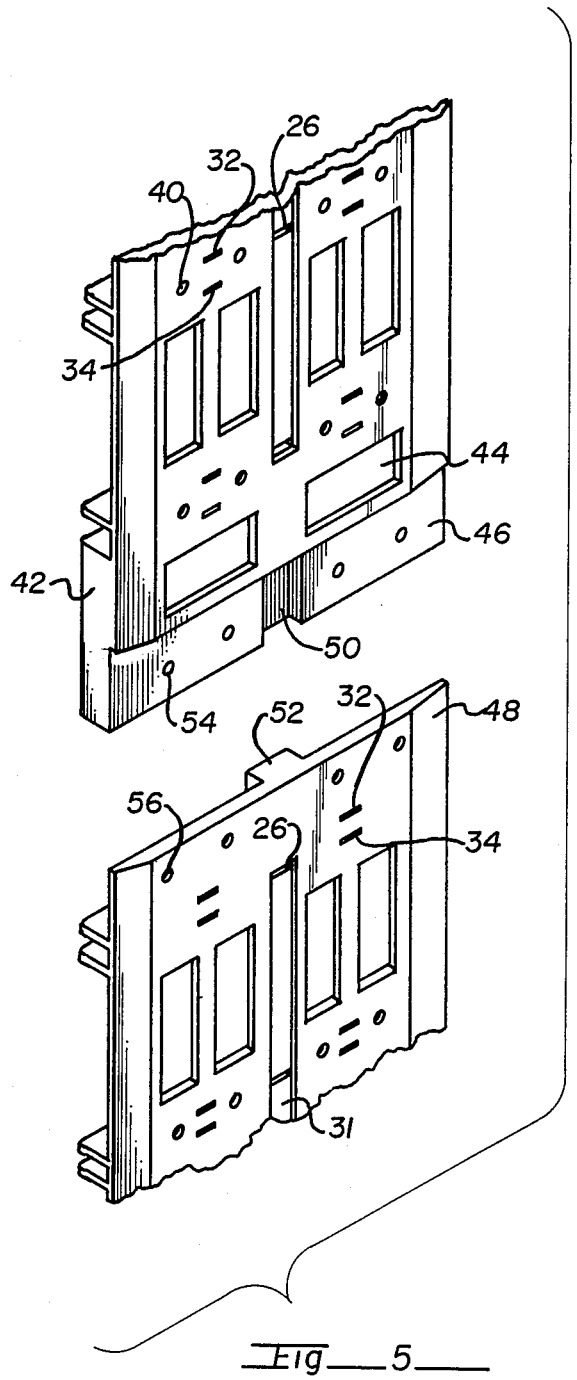
FIG. 5 is a perspective view showing how the lower edge of an upper Smitty Post may be fastened to the upper edge of a lower Smitty Post to double the height of the table

At the various shelf levels B-F are upper lips 36, 38 between which the edges of the shelving are placed. Typically the spacing is such that ½ inch ply or particle board fits snug between the lips. As an option to banding the table parts together, holes 40 in the Smitty Post are provided between the lips 36, 38 for nailing or fastening the posts and shelves together with screws. Pallet base board 20 at shelf level A preferable is of ¾ inch ply board that will support the entire rack on forklift arms. The forklift arms may straddle posts 12, 16 or posts 14, 18 and pass under pallet base board 20 from any of the four directions. The leg portion 42 of the Smitty Posts 12, 14, 16 and 18 which extend below pallet base board 20 are thicker and heavier than the upper portion for strength rigidity and durability. However, recessed portions 44 are provided to permit uniform cooling when the plastic posts are molded. As will be explained later, the lower part 46 of leg portion 42 is recessed to engage the upper portion 48 of another Smitty Post when stacking this table on top of another one. This lower part 46 has a further recession 50 to accommodate top post 52 that extends up from above the upper lips 36, 38 on the inside of upper portion 48. As shown in FIG. 5 opening 54 in the lower part 46 match the openings 56 in the upper edge for securing stacked tables together with fasteners such as nuts and bolts or screws.

Figure 2:
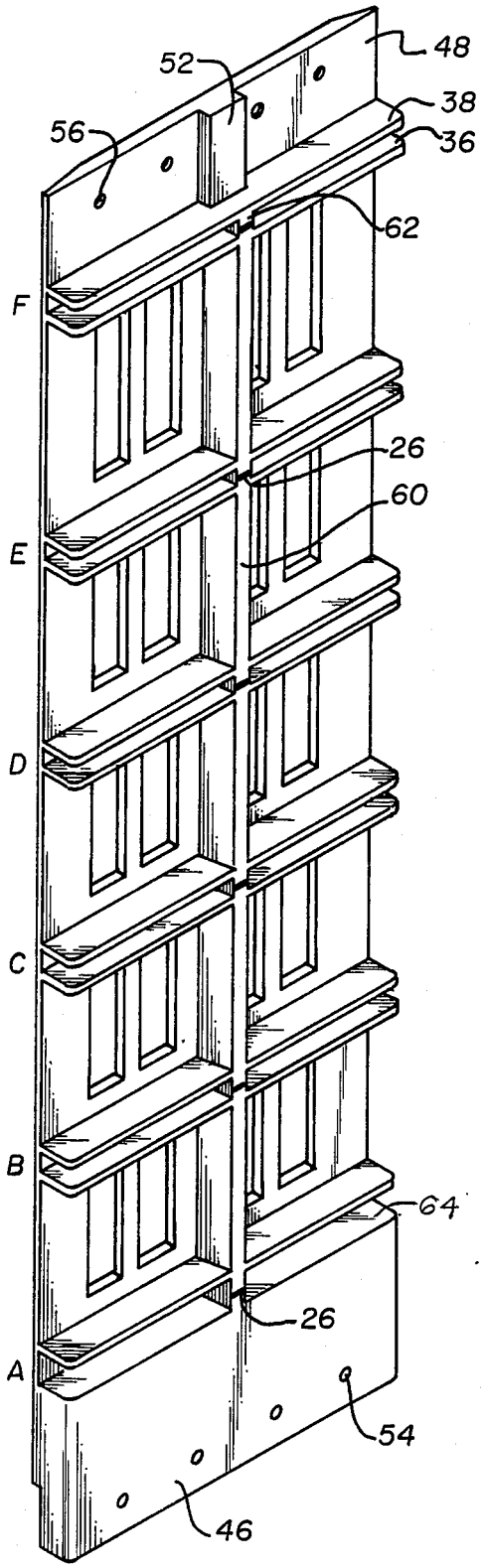
FIG. 2 is a perspective view showing the inside of one of the supports or Smitty Posts.

As will be seen hereinafter in FIG. 3, the pallet base board and shelves have V-shaped centering notches 58 through which bands 28, 30 may be placed to pass either over or under the pallet base board and shelves as desired. As shown in FIG. 2, centering reinforcement beams 60 extend vertically from top post 52 to leg portion 42 on the Smitty Posts. These beams are of truncated conical shape in cross-section between lips 36, 38 so as to be self-centering when that portion 62 between lips 36, 38 fits into these notches. The rest of the beams 60 also may be of truncated conical shape in cross-section or they may be of square or rectangular cross section, as desired. They also may be shaped to fit products being transported by the table.

Reference is now made to FIG. 2 which is a perspective view showing the inside of one of the supports. aThe various shelf levels B-F have lower and upper lips 36, 38 to receive shelving in between. Level A has an upper lip and the upper surface 64 of leg portion 42 between which the edge of a thicker pallet may be positioned. This upper lip must support the whole table and its products when they are raised by a forklift. It can be seen that slots 26 extend through wedge portion 62 between the lips. Top post 52 is an extension of wedge 62 and reinforces upper portion 48. It should be noted that the vertical edges of the Smitty Post are feathered to facilitate side by side loading of the tables in a semi-trailer. Openings 56 at the top portion 48 and openings or pilot holes 54 in lower part 46 extend through the post to permit fastening with nuts and bolts or self-tapping screws when vertical stacking of the tables is done. A stack of three tables constitutes a rack.

Figure 3:
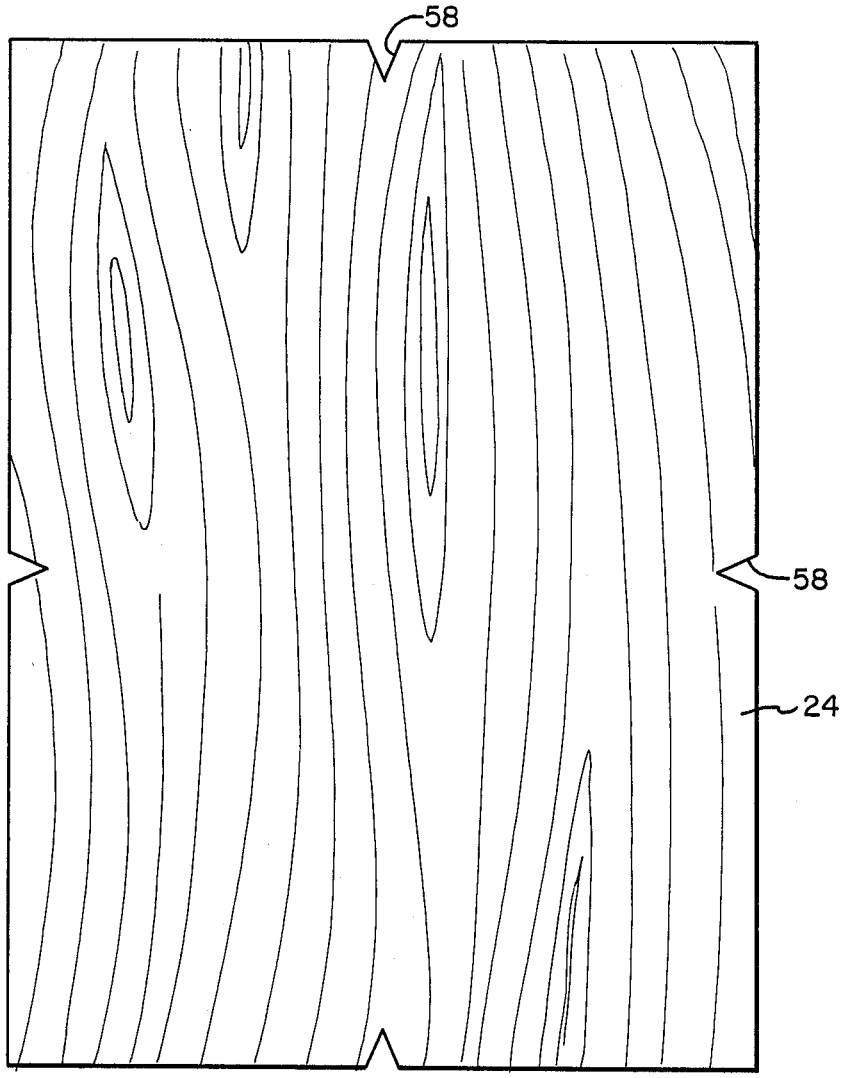
FIG. 3 is a plan view of a shelf with centering notches.

FIG. 3 is a plan view of a typical shelf 24 used in the table 10 of this invention. This shelf typically is ½ inch ply board 32 inches wide and 43⅞ inches long. While this is typical, the shelf material, thickness and dimensions may vary according to the commodities being stored, displayed or transported. At the midpoint of each edge is a notch 58 which typically is 2 inches deep and 1½ inches across the base. As previously mentioned and as shown in FIG. 4, these notches receive the wedges 62 of the Smitty Posts to center them along the edges of the shelf.

Figure 4:
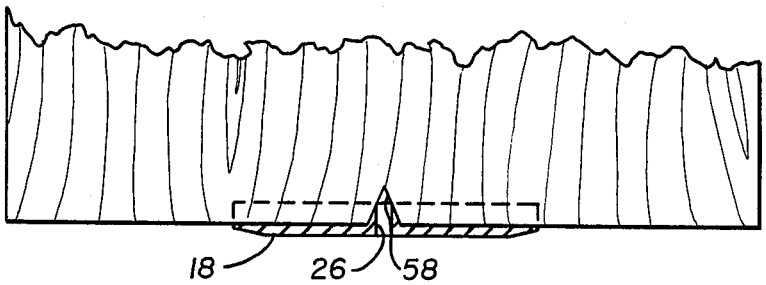
FIG. 4 is a partial plan view showing how the Smitty Post is centered by the shelf.

FIG. 4 is a partial plan view showing how the Smitty Post 18 is centered along an edge of shelf 24. Here can be seen shelf 24 with notch 58 receiving lower lip 36 under it and Smitty Post 18 bearing against the edge of shelf 24. Slots 26 extend through the wedges 62 to permit passage of the tie bands 28 or 30, shown in FIG. 1, therethrough.

FIG. 5 shows how the lower part 46 of the upper section may be attached and fastened to the upper portion 48 of the lower section when table 10 is stacked over another. As earlier mentioned upper portion 48 has a central post 52. This requires a mating recession 50 in the recessed lower part 46 of leg portion 42 of the upper section. The lower recessed part 46 of the upper section fits inside and against upper portion 48 of the lower section. Openings or pilot holes 54 match with openings 56 for nut and bolt or self tapping screw fastening therethrough.

Having described the preferred embodiment wherein my invention is utilized, it will occur to those skilled in the art that numerous modifications and changes may be made and it is to be understood that these various alternate forms are to be considered as part of the present inventionas set forth in the following claims.

What I claims is:

1. A collapsible shipping, storing and displaying table comprising:

a raised pallet base of rectangular configuration having four way forklift entries thereunder, support posts attached to the mid-sections of said pallet base on each of the sides thereof, said support posts having leg portions above which said pallet base is attached to permit forklift entry below said pallet base, said support posts having vertically spaced shelf attachments above said leg portions, and a plurality of shelves adapted to be connected to said attachments.

2. A collapsible shipping, storing and displaying table as set forth in claim 1 wherein said shelf attachments comprise spaced horizontal lips adapted to receive a shelf edge therebetween, and means for retaining said shelf edges within said lips.

3. A collapsible shipping, storing and displaying table as set forth in claim 2 wherein said shelves have notches at the mid-sections of the edges thereof, said support posts having wedge portions between said lips to be received by said notches to position said support posts midway along said shelf edges.

4. A collapsible shipping, storing and displaying table as set forth in claim 3 wherein said wedge portions have slots therein aligned with said shelf notches to permit passage of fastening bands through said slots and notches and in contact with the surfaces of said shelves, said bands having a closed loop configuration to maintain said posts and said shelves in assembled condition.

5. A collapsible shipping, storing and displaying table as set forth in claim 1 wherein said support posts have mating recesses at the tops and bottoms thereof whereby one table may be stacked above and fastened to another table.

* * * * *